US005803144A

United States Patent [19]

Ives

[11] Patent Number: 5,803,144

[45] Date of Patent: Sep. 8, 1998

[54] MULTIPURPOSE VALANCE ASSEMBLY

[75] Inventor: Russell J. Ives, Singer Island, Fla.

[73] Assignee: Newval, Inc., West Palm Beach, Fla.

[21] Appl. No.: 507,661

[22] Filed: Jul. 25, 1995

[51] Int. Cl.[6] ..... E06B 9/00

[52] U.S. Cl. ..... 160/38; 160/39

[58] Field of Search ..... 160/38, 39, 19, 160/330; 5/493; 248/262, 263, 265

[56] References Cited

U.S. PATENT DOCUMENTS

| | | | |
|---|---|---|---|
| 2,168,421 | 8/1939 | Reynolds et al. . | |
| 2,277,240 | 3/1942 | Lowry | 160/38 |
| 2,672,192 | 3/1954 | Goldner . | |
| 2,823,743 | 11/1958 | Isaac . | |
| 3,137,890 | 6/1964 | Kochanowski . | |
| 3,297,075 | 1/1967 | Howell et al. . | |
| 3,574,887 | 4/1971 | Schindlauer . | |
| 4,014,072 | 3/1977 | Schumacher | 160/38 X |
| 4,079,770 | 3/1978 | Woodle . | |
| 4,114,233 | 9/1978 | Hamilton . | |
| 4,222,427 | 9/1980 | Buchner . | |
| 4,384,605 | 5/1983 | Schaeffer et al. . | |
| 4,662,421 | 5/1987 | Basmadji et al. . | |
| 4,840,216 | 6/1989 | John . | |
| 4,930,562 | 6/1990 | Goodman . | |
| 4,957,255 | 9/1990 | John . | |
| 5,042,548 | 8/1991 | Attal . | |
| 5,230,375 | 7/1993 | Linder . | |
| 5,259,687 | 11/1993 | John . | |

FOREIGN PATENT DOCUMENTS

| | | | |
|---|---|---|---|
| 2231626 | 1/1974 | Germany | 160/38 |

OTHER PUBLICATIONS

Laserlite Executive Series Valance Brochure, All–Teck P.T.B., Inc., Canada (1990).

Allied–All–Teck Product Guide, Valance Products Section 3, Plastibec Ltee, Canada (1994).

LouverDrape Product Catalog, p. 11, LouverDrape, U.S.A.

*Primary Examiner*—Blair Johnson

*Attorney, Agent, or Firm*—Fish & Neave; Thomas L. Secrest

[57] ABSTRACT

A multipurpose valance assembly is provided in which valance attachments may be removeably engaged to a valance base or a preexisting window treatment system. Each valance attachment holds a decorative insert, which may be a conventional valance or a drapery fabric panel assembly. Because the invention allows for multiple valance attachments in adjustable engagement with one another, and a variety of interchangeable decorative inserts, the multipurpose valance assembly creates a wide array of new decorative effects. In addition, a valance adapter allows the invention to be retrofit to preexisting window treatment systems, substantially reducing the labor and material costs associated with installing new window treatment systems.

30 Claims, 4 Drawing Sheets

FIG. 5
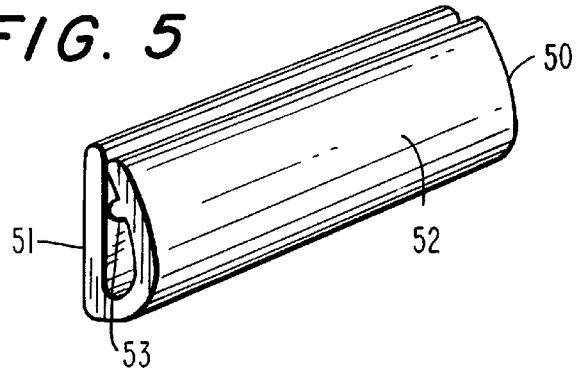
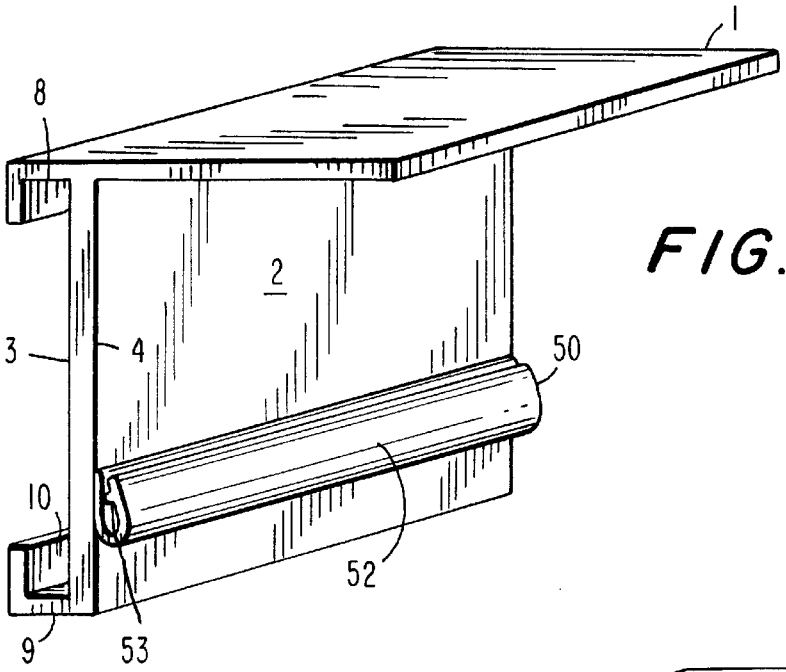
FIG.6
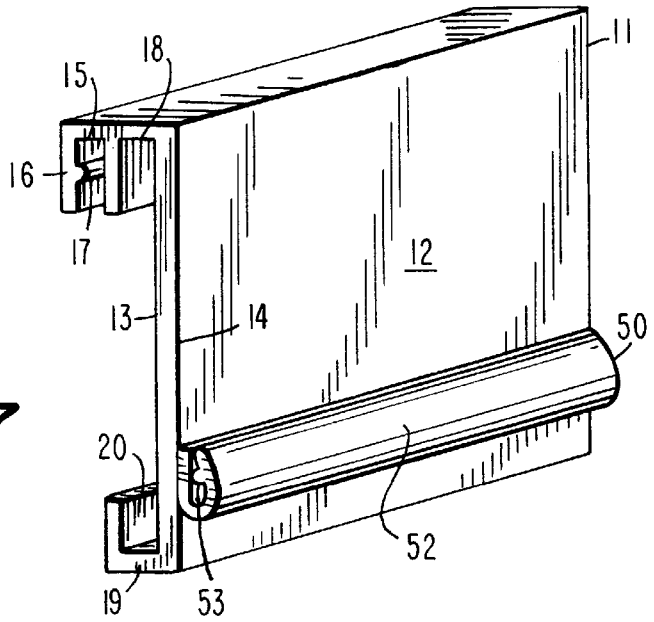
FIG.7

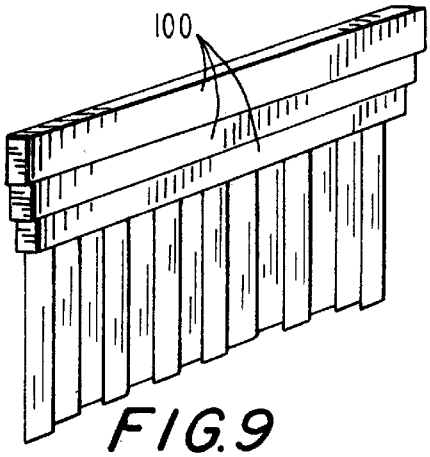
FIG. 9
FIG. 8
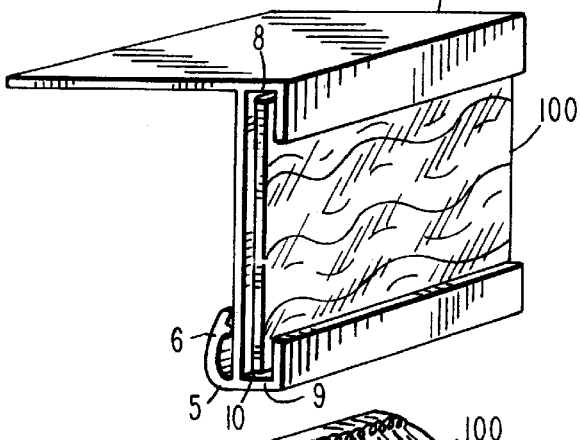
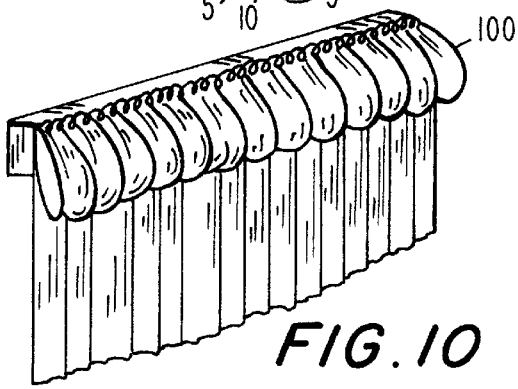
FIG. 10
FIG. 11
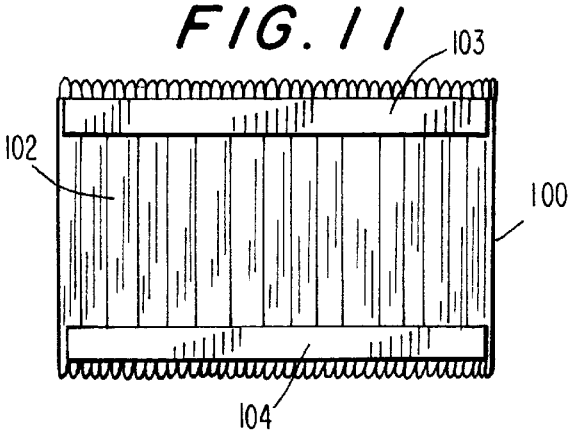
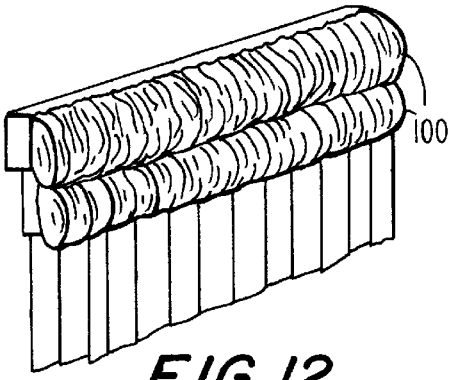
FIG. 12
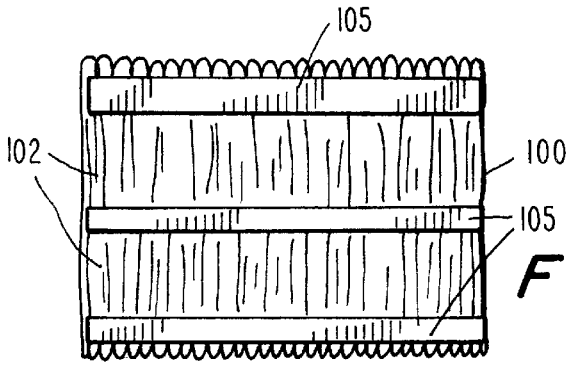
FIG. 13

FIG. 14
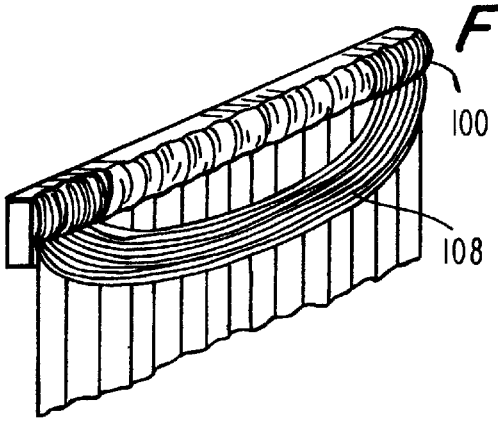
FIG. 15
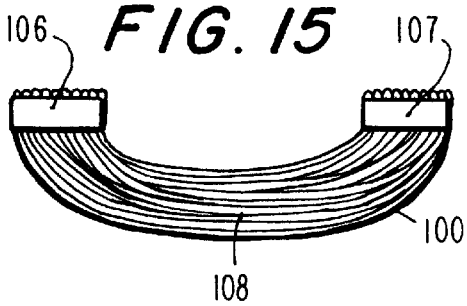
FIG. 16
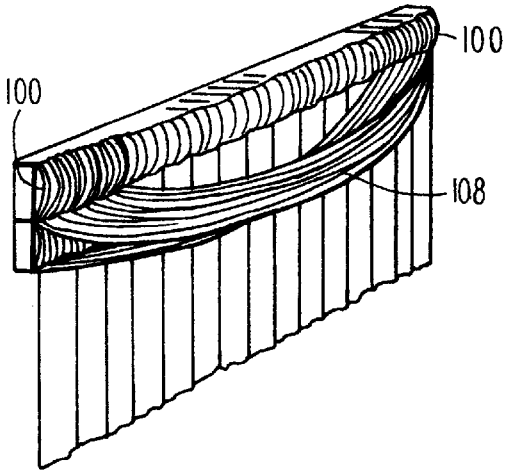
FIG. 18
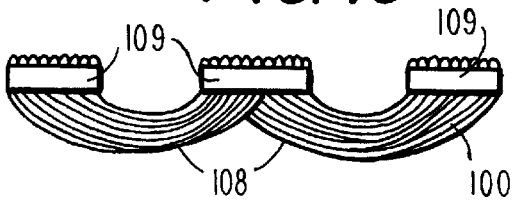
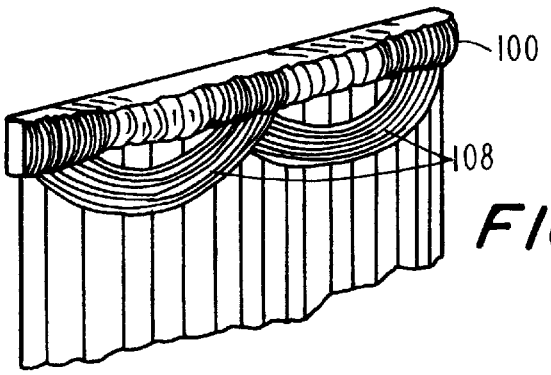
FIG. 17

MULTIPURPOSE VALANCE ASSEMBLY

BACKGROUND OF THE INVENTION

This invention pertains to window treatments used in blind and drapery systems. More particularly, this invention pertains to a multipurpose valance assembly that may be used with existing blind and drapery systems or to create new blind and drapery systems. The invention provides a valance attachment with a longitudinal channel for receiving decorative inserts and a longitudinal attachment means for engaging the valance attachment with existing window treatment systems or a valance base with a receiver means. The valance attachment also may have a receiver means for engaging an additional valance attachment at its attachment means. The receiver means may be extruded along with the body of the valance attachment or base, or it may be a separate valance adapter that is simply and adjustably affixed to the body of the valance attachment or valance base. Because a plurality of valance attachments may be engaged with one another, and a variety of decorative inserts may be used with each valance attachment, the invention achieves a wide array of new decorative effects.

Prior art valance systems could not achieve the wide array of decorative effects available using the present invention. Prior art valance constructions, such as U.S. Pat. No. 3,297,075 to Howell et al, U.S. Pat. No. 4,079,770 to Woodle, 4,662,421 to Basmadji et al., 5,042,548 to Attal, and 5,259,687, 4,957,255 and 4,840,216 to John, for example, provide window treatment devices that could be attached at defined locations to a supporting base. These patents did not show a plurality of valance attachments engaged to one another. Nor did they allow for adjusting the placement of the window treatment device on the supporting base.

Prior art drapery fabric window treatments were difficult to install, expensive to produce and not easily adaptable to suit the end user's preferences. U.S. Pat. No. 4,930,562 to Goodman advanced the drapery art by disclosing a fabric decorative member attached into a channel of a conventional valance or vertical blind slat. However, U.S. Pat. No. 4,930,562 did not show the engagement of a plurality of valance attachments, each capable of receiving a fabric decorative member, to create multi-layered balloon valance effects. Nor did it contemplate the use of decorative members with fabric draped between two lateral portions of the member, to create a variety of drapery swag effects.

Finally, the prior art window treatment systems, including those patents discussed above, were extremely limited in their ability to retrofit existing blind and drapery systems. To the extent the prior art window treatments were retrofitable, they could only be used to retrofit particular systems for which they were uniquely adapted. This invention is universal, in that it may be used to retrofit most window treatment systems provided by a variety of manufacturers.

SUMMARY OF THE INVENTION

The multipurpose valance assembly of this invention includes a valance base that has an elongate, substantially rectangular panel, a longitudinal channel, formed between its top and bottom lips, for holding a decorative insert, and a receiver means extending longitudinally across the rear face of the panel. The invention also includes an elongate, substantially rectangular valance attachment with a similar longitudinal channel for holding a decorative insert, and a longitudinal attachment means at the top of its front face. The valance attachment also may have a receiver means extending longitudinally across its rear face. The attachment means of the valance attachment is removably engaged with the receiver means of the valance base or another valance attachment.

It is an object of this invention to provide a multipurpose valance assembly that may be used to create new decorative effects.

It is a further object of this invention to provide a multipurpose valance assembly that is easily adjustable according to the end users' preferences.

It is a further object of this invention to provide a multipurpose valance assembly that is retrofitable to existing window treatment systems.

It is a further object of this invention to provide means to create new multilayered window treatments using a plurality of valance attachments in removeable engagement with each other.

It is a further object of this invention to provide a new means to achieve the decorative effects of conventional balloon valances and drapery swags at a fraction of the material and labor cost.

These and other objects and advantages of the invention will be apparent from the following detailed description of the preferred embodiment of the invention taken in conjunction with the drawings, which illustrate by way of example the principles of the invention.

BRIEF DESCRIPTION OF THE DRAWINGS

FIG. 5 is a perspective view of the valance adapter of this invention.

FIG. 6 is a rear perspective view of the valance adapter of this invention affixed to and acting as the receiver means of the valance base.

FIG. 7 is a rear perspective view of the valance adapter of this invention affixed to and acting as the receiver means of the valance attachment.

FIG. 8 is a front perspective view of the valance base of this invention holding a decorative insert.

FIG. 9 is a perspective view of a shadow box valance created using this invention.

FIG. 10 is a perspective view of a balloon valance created using this invention.

FIG. 11 is a rear view of the decorative insert of this invention used to create the balloon valance of FIG. 10.

FIG. 12 is a perspective view of a multi-layered balloon valance created using this invention.

FIG. 13 is a rear view of the decorative insert of this invention used to create the multi-layered balloon valance of FIG. 12.

FIG. 14 is a perspective view of a drapery swag window treatment created using this invention.

FIG. 15 is a rear view of the decorative insert of this invention used to create the drapery swag window treatment of FIG. 14.

FIG. 16 is a perspective view of an overlapping drapery swag window treatment created using this invention.

FIG. 17 is perspective view of a multi-swag window treatment created using this invention.

FIG. 18 is a rear view of the decorative insert of this invention used to create the multi-swag window treatment of FIG. 17.

DETAILED DESCRIPTION OF THE PREFERRED EMBODIMENT

Figure 1:
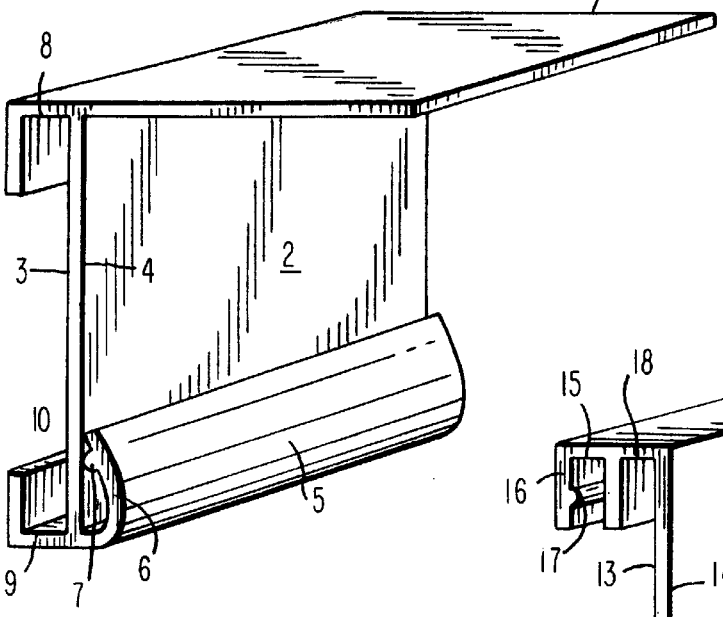
FIG. 1 is a rear perspective view of the valance base of this invention.

The multipurpose valance assembly of this invention has a valance base 1 as shown in FIG. 1. The valance base is preferably extruded polyvinylchloride (PVC), commonly used in the window treatment industry, but may be made from any extrudable material or other material suitable for construction of window valances.

The valance base 1 has an elongate, substantially rectangular panel 2 with a front face 3 and a rear face 4. The valance base has a generally L-shaped upper lip 8 and lower lip 9 on the top and bottom edges of the front face 3 of the panel 2. Between the upper lip 8 and the lower lip 9, a channel 10 is formed for receiving a decorative insert 100 as described below.

Figure 3:
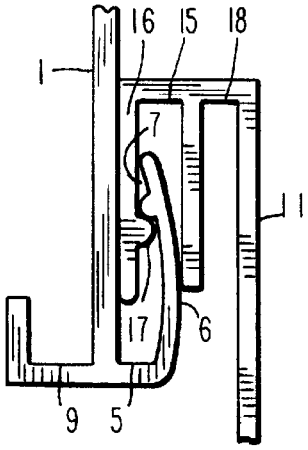
FIG. 3 is a cross-sectional view of the receiver means of the valance base engaged with the attachment means of the valance attachment of this invention.

Extending longitudinally across the length of the rear face 4 of the panel 2 is a generally U-shaped receiver means 5. The receiver means 5 has as one leg a portion of the panel 2 and as its other leg a receiver flange 6 extending the length of the receiver means 5 and doubled back on the panel portion. Extending the length of the receiver flange 6 is a locking ridge 7 that removeably engages a locking ridge of an attachment means 15 of a valance attachment 11 as shown in FIG. 3.

Figure 2:
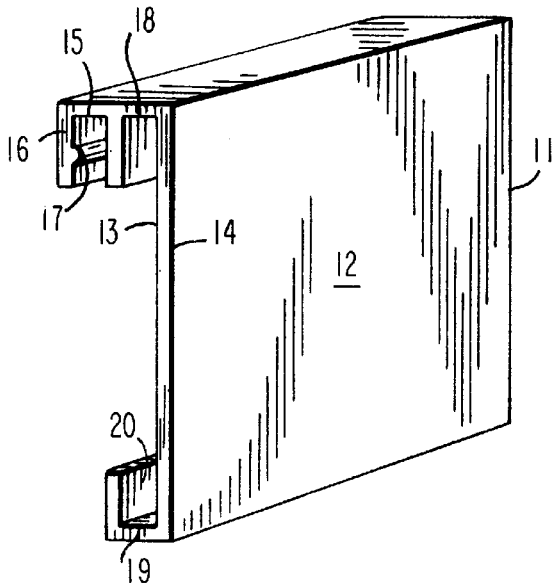
FIG. 2 is a rear perspective view of the valance attachment of this invention.

The valance attachment 11 of this invention is shown in FIG. 2. The valance attachment has an elongate, substantially rectangular panel 12 with a front face 13 and a rear face 14. The valance attachment 11 has a generally L-shaped upper lip 18 and lower lip 19 on the top and bottom edges of the front face 13 of the panel 12. Between the upper lip 18 and the lower lip 19, a channel 20 is formed for receiving a decorative insert 100 as described below.

Extending longitudinally across the upper edge of the front face 13 of the panel 12 and adjacent its upper lip 18, is a generally U-shaped attachment means 15. The attachment means 15 has as one leg the outer portion of the upper lip 18 and as its other leg an attachment flange 16 extending the length of the attachment means 15 and generally parallel to the outer-portion of the upper lip. Extending the length of the attachment flang 16 is a locking ridge 17 that removeably engages the locking ridge 7 of a receiver means as shown in FIG. 3.

Figure 4:
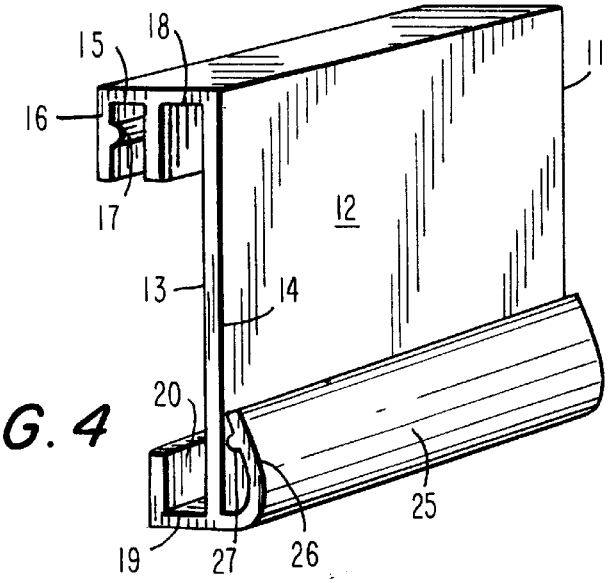
FIG. 4 is a rear perspective view of the valance attachment of this invention with a receiver means.

As shown in FIG. 4, the valance attachment 11 of the invention also may have a generally U-shaped receiver means 25. The receiver means 25 has as one leg a portion of the panel 12 and as its other leg a receiver flange 26 extending the length of the receiver means 25 and doubled back on the panel portion. Extending the length of the receiver flang 26 is a locking ridge 27 that removeably engages the locking ridge 17 of the attachment means 15 of another valance attachment 11.

As shown in FIG. 3, the attachment means 15 of the valance attachment 11 may be removably engaged with the receiver means 5 of the valance base 1. The attachment flange 16 is slid into the receiver means 5 of the valance base 1 and the attachment flange locking ridge 17 is snapped into position adjacent the receiver means locking ridge 7, providing removeable engagement of the valance attachment 11 to the valance base 1. In another embodiment (not shown), the attachment means 15 of the valance attachment 11 may be removably engaged with the receiver means 25 of another valance attachment by snapping the attachment flange locking ridge 17 into position adjacent the receiver flange 27 of another valance attachment 11.

As shown in FIG. 1, receiver means 5 may be extruded along with panel 2 of the valance base 1. Similarly, as shown in FIG. 4, receiver means 25 may be extruded with panel 12 of the valance attachment 11. In either embodiment, it is preferable to extrude the receiver means 5 and 25 with the valance base 1 or the valance attachment 11 in a single extrusion process.

Alternatively, as shown in FIG. 6, the receiver means may be formed by fixedly attaching a longitudinal valance adapter 50 across the rear face 4 of the valance base 1. The valance adapter 50 may be affixed to the rear face 4 of the valance base 1 using an adhesive commonly used in the window treatment art or any other suitable method of adhesion. As shown in FIG. 5, the generally U-shaped valance adapter 50 has a first leg 51 that is longitudinally affixed to the rear face 4 of the valance base 1 and another leg that is an adapter flange 52 doubled back on the first leg 51 of the valance adapter. Extending the length of the adapter flang 52 is a locking ridge 53 that removeably engages the locking ridge 17 of the attachment means 15 of a valance attachment 11, as described above.

Similarly, valance adapter 50 may be fixedly attached across the rear face 14 of a valance attachment 11, allowing the valance attachment 11 to receive and removeably engage the attachment flange 16 of another valance attachment. This embodiment is shown in FIG. 7.

Alternatively, valance adapter 50 may be fixedly attached to any rear surface of a preexisting window treatment system. The valance adapter 50 allows the preexisting window treatment system to receive and removeably engage the attachment flange 16 of valance attachment 11 of this invention. In this way, the invention allows existing blind and drapery systems to be retrofit easily and inexpensively to achieve new decorative effects.

The valance adapter 50 may be affixed to valance base 1, valance attachment 11 or a preexisting window treatment system at a variety of horizontal positions. By adjusting the horizontal position of the valance adapter 50, the end user can adjust the height of the exposed portion of the valance attachment 11. For example, by attaching the valance adapter 50 high on the valance base 1, the exposed portion of the valance attachment 11 is substantially reduced, creating the appearance of a shorter valance attachment.

In addition, a plurality of valance adapters 50 may be fixedly attached to valance base 1, valance attachment 11, or existing window treatment systems to create a variety of multi-layered effects.

As shown in FIG. 8, decorative insert 100, which may be made in a variety of different configurations from a variety of different materials as discussed below, is slid into longitudinal channel 10 of the valance base 1 or longitudinal channel 20 of a valance attachment 11. Longitudinal channels 10 and 20 hold decorative insert 100 securely in its desired position on valance base 10 or valance attachment 11. Decorative insert 100 may be easily removed or replaced by sliding it out of channel 10 of valance base 1 or channel 20 of valance attachment 11.

Referring to FIG. 9, the decorative insert 100 of the present invention may be a conventional window valance decorative insert well known in the window treatment industry. FIG. 9 shows a shadowbox valance created with a plurality of valance attachments 11 (not shown) used in conjunction with conventional window valance decorative inserts 100.

FIG. 11 shows another embodiment of the invention in which the decorative insert 100 may be comprised of substantially rigid insertion panels 103 and 104 that are substantially the same length as longitudinal channels 10 and 20 of the valance base 1 and valance attachment 11. Insertion panels 103 and 104 are connected by a soft drapery fabric panel 102. The drapery fabric panel 102 may be sewn to the insertion panels 103 and 104 or may be attached using an adhesive commonly used in the window treatment art or any other suitable method of adhesion. Insertion panel 103 is slid into and held by the longitudinal channel 10 of valance base 1 or the longitudinal channel 20 of a valance attachment 11. Insertion panel 104 is then slid into and held by the longitudinal channel 20 of a valance attachment 11. In this way, a balloon valance drapery effect is achieved using the multipurpose valance assembly of the present invention as shown in FIG. 10. Such balloon valance effects may be achieved more easily with the invention than with conventional drapery constructions, at a fraction of the labor and material costs.

As shown in FIG. 13, a plurality of insertion panels 105 may be attached along the length of the soft fabric panel 102. Each additional insertion panel 105 is slid into and held by longitudinal channels 20 of additional valance attachments 11. The invention thus creates multi-layered balloon valance effects as shown in FIG. 12, again at substantial cost savings over conventional drapery constructions.

FIG. 15 shows yet another embodiment of the invention in which the decorative insert 100 may be comprised of substantially rigid insertion panels 106 and 107 that are shorter in length than longitudinal channels 10 and 20 of the valance base 1 and valance attachment 11. Insertion panels 106 and 107 are connected by a soft drapery fabric panel 108. The drapery fabric panel 108 may be sewn to the insertion panels 106 and 107 or may be attached using an adhesive commonly used in the window treatment art or any other suitable method of adhesion.

Insertion panel 106 is slid into and held at a portion of the longitudinal channel 10 of valance base 1. Insertion panel 107 is then slid into and held in spaced separation from insertion panel 106 at another portion of the longitudinal channel 10 of valance base 1. Drapery fabric panel 108 is draped between insertion panels 106 and 107. Of course, one or both of the insertion panels 106 and 107 may be held at a portion of the longitudinal channel 20 of valance attachment 11. Thus, a drapery swag effect may be achieved using the multipurpose valance assembly of the present invention as shown in FIG. 14. In addition, as shown in FIG. 16, a plurality of decorative inserts 100 may be held at portions of the longitudinal channels 20 of a plurality of valance attachments, creating an overlapping swag effect. Such swag effects may be achieved more easily with the invention than with conventional drapery constructions, at a fraction of the labor and material costs.

Furthermore, a plurality of insertion panels 109 may be attached along the length of soft fabric panel 108 as shown in FIG. 18. Each additional insertion panel 109 is slid into and held in spaced separation from other insertion panels 109 at portions of longitudinal channels 10 or 20 of valance base 1 or additional valance attachments 11 to create a multi-swag effect as shown in FIG. 17. Thus, multi-swag effects may be achieved using the multipurpose valance assembly of this invention, again at substantial cost savings over conventional drapery constructions.

Although the present invention has been described in detail with reference to various embodiments, it should be understood by those skilled in the art that various modifications can be made without departing from the invention. Accordingly, the invention is limited only by the claims that follow.

I claim:

1. A multipurpose valance assembly for use in window treatment systems comprising:

a valance base that has (a) an elongate, substantially rectangular panel with a front face and a rear face, (b) longitudinal upper and lower lips formed on the front face of the panel at its longitudinal top and bottom edges, (c) a longitudinal channel formed between the upper and lower lips of the panel for introducing and holding a decorative insert, and (d) a substantially continuous receiver means extending longitudinally across a length of the rear face of the panel and extending from a plane of said rear face;

a valance attachment that has (a) an elongate, substantially rectangular panel with a front face and a rear face, (b) longitudinal upper and lower lips formed on the front face of the panel at its longitudinal top and bottom edges, (c) a longitudinal channel formed between the upper and lower lips of the panel for introducing and holding a decorative insert, and (d) a longitudinal attachment means formed on the front face of the panel and adjacent the upper lip and extending from a plane of said upper lip;

wherein the attachment means of the valance attachment is removably engaged with the receiver means of the valance base.

2. The multipurpose valance assembly of claim 1 wherein the valance attachment has a receiver means for removeably engaging the attachment means of another valance attachment.

3. The multipurpose valance assembly of claim 2 wherein a plurality of valance attachments are removeably engaged to one another at their receiver means.

4. The multipurpose valance assembly of claim 2 wherein the receiver means of the valance attachment is extruded with the panel of the valance attachment.

5. The multipurpose valance assembly of claim 2 wherein the receiver means of the valance attachment is formed by fixedly attaching a valance adapter to the rear face of the valance attachment.

6. The multipurpose valance assembly of claim 5 wherein the valance adapter may be affixed to the valance attachment at a variety of horizontal positions.

7. The multipurpose valance assembly of claim 6 wherein a plurality of valance adapters are affixed to the valance attachment.

8. The multipurpose valance assembly of claim 1 wherein the receiver means of the valance base is extruded with the panel of the valance base.

9. The multipurpose valance assembly of claim 1 wherein the receiver means of the valance base is formed by fixedly attaching a valance adapter to the rear face of the valance base.

10. The multipurpose valance assembly of claim 9 wherein the valance adapter may be affixed to the valance base at a variety of horizontal positions.

11. The multipurpose valance assembly of claim 10 wherein a plurality of valance adapters are affixed to the valance base.

12. The multipurpose valance assembly of claim 1 wherein at least one decorative insert is inserted into at least one of the longitudinal channels.

13. The multipurpose valance assembly of claim 12 wherein the decorative inserts further comprise a plurality of substantially rigid insertion panels connected by a soft drapery fabric panel.

14. The multipurpose valance assembly of claim 13 wherein the insertion panels are substantially the same length as the longitudinal channels of the valance base and the valance attachment.

15. The multipurpose valance assembly of claim 13 wherein the insertion panels are shorter in length than the longitudinal channels of the valance base and valance attachment.

16. The multipurpose valance assembly of claim 12 wherein the decorative inserts further comprise continuous substantially rigid insertion panels substantially the same length as the longitudinal channels of the valance base and the valance attachment.

17. A multipurpose valance assembly for use in window treatment systems comprising:

an elonagated valance base with a substantially continuous receiver means attached thereto, defining a valance adapter for fixedly attaching to a component of a preexisting window treatment system; said reciever means extending along a length of said valance base and extending from a plane of said valance base;

a valance attachment that has (a) an elongate, substantially rectangular panel with a front face and a rear face, (b) longitudinal upper and lower lips formed on the front face of the panel at its longitudinal top and bottom edges, (c) a longitudinal channel formed between the upper and lower lips of the panel for introducing and holding a decorative insert, and (d) a longitudinal attachment means formed on the front face of the panel and adjacent the upper lip and extending from a plane of said upper lip;

wherein the attachment means of the valance attachment is removably engaged with the receiver means of the valance base.

18. The multipurpose valance assembly of claim 17 wherein the valance adapter may be affixed to the component of the preexisting window treatment system at a variety of horizontal positions.

19. The multipurpose valance assembly of claim 18 wherein a plurality of valance adapters are affixed to the component of the preexisting window treatment system.

20. The multipurpose valance assembly of claim 17 wherein the valance attachment has a receiver means for removeably engaging the attachment means of another valance attachment.

21. The multipurpose valance assembly of claim 20 wherein the receiver means of the valance attachment is extruded with the panel of the valance attachment.

22. The multipurpose valance assembly of claim 20 wherein the receiver means of the valance attachment is formed by fixedly attaching a valance adapter to the rear face of the valance attachment.

23. The multipurpose valance assembly of claim 22 wherein the valance adapter may be affixed to the valance attachment at a variety of horizontal positions.

24. The multipurpose valance assembly of claim 23 wherein a plurality of valance adapters are affixed to the valance attachment.

25. The multipurpose valance assembly of claim 20 wherein a plurality of valance attachments are removeably engaged to one another at their receiver means.

26. The multipurpose valance assembly of claim 17 wherein at least one decorative insert is inserted into the longitudinal channel.

27. The multipurpose valance assembly of claim 26 wherein the decorative insert further comprises a continuous substantially rigid insertion panel substantially the same length as the longitudinal channel of the valance attachment.

28. The multipurpose valance assembly of claim 26 wherein a plurality of valance attachments are removably engaged to one another at their receiver means and wherein the decorative insert further comprises a plurality of substantially rigid insertion panels connected by a soft drapery panel.

29. The multipurpose valance assembly of claim 28 wherein the insertion panels are substantially the same length as the longitudinal channels of the valance attachments.

30. The multipurpose valance assembly of claim 28 wherein the insertion panels are shorter in length than the longitudinal channels of the valance attachments.

* * * * *